US008365508B2

(12) United States Patent
Kenney

(10) Patent No.: US 8,365,508 B2
(45) Date of Patent: Feb. 5, 2013

(54) BANDING OF PRODUCTS

(76) Inventor: Jason David Kenney, Madison, WI (US)

( * ) Notice: Subject to any disclaimer, the term of this patent is extended or adjusted under 35 U.S.C. 154(b) by 0 days.

(21) Appl. No.: 13/498,950

(22) PCT Filed: Oct. 20, 2010

(86) PCT No.: PCT/US2010/053325

§ 371 (c)(1),
(2), (4) Date: Mar. 29, 2012

(87) PCT Pub. No.: WO2011/050029

PCT Pub. Date: Apr. 28, 2011

(65) Prior Publication Data

US 2012/0199019 A1 Aug. 9, 2012

Related U.S. Application Data

(60) Provisional application No. 61/253,539, filed on Oct. 21, 2009, provisional application No. 61/329,296, filed on Apr. 29, 2010.

(51) Int. Cl.
*B65B 13/02* (2006.01)

(52) U.S. Cl. ..... 53/589; 53/399; 53/414; 53/419; 100/27

(58) Field of Classification Search ..... 53/399, 53/582, 588, 589, 414, 419; 100/27
See application file for complete search history.

(56) References Cited

U.S. PATENT DOCUMENTS

| | | | | | |
|---|---|---|---|---|---|
| 2,630,751 | A * | 3/1953 | Cranston et al. | 100/27 |
| 3,324,789 | A * | 6/1967 | Buettner | 100/27 |
| 4,079,565 | A * | 3/1978 | Lancaster et al. | 53/397 |
| 4,166,348 | A * | 9/1979 | Carlson | 53/556 |
| 4,178,739 | A * | 12/1979 | Du Broff | 53/588 |
| 4,593,590 | A | 6/1986 | Gray | |
| 4,620,408 | A * | 11/1986 | Parnes | 53/77 |
| 4,661,185 | A * | 4/1987 | Kobiella | 156/212 |
| 4,836,873 | A * | 6/1989 | Mitanihara et al. | 156/157 |
| 4,850,177 | A | 7/1989 | Laczkowski et al. | |
| 4,936,073 | A | 6/1990 | Laczkowski et al. | |
| 5,027,581 | A * | 7/1991 | Kovacs | 53/399 |
| 5,070,676 | A | 12/1991 | Laczkowski et al. | |
| 5,088,270 | A | 2/1992 | Diehl | |
| 5,404,691 | A * | 4/1995 | Scherer | 53/399 |
| 5,694,748 | A | 12/1997 | Rochman et al. | |
| 5,916,108 | A * | 6/1999 | Drietz et al. | 53/370 |
| 6,192,653 | B1 * | 2/2001 | Maekawa et al. | 53/204 |
| 6,625,954 | B2 | 9/2003 | Forrest | |
| 6,817,159 | B2 * | 11/2004 | Sakaki et al. | 53/399 |
| 7,516,694 | B1 * | 4/2009 | Eifler | 100/27 |
| 7,661,244 | B2 * | 2/2010 | Downhill | 53/176 |
| 2003/0061785 | A1 * | 4/2003 | Sakaki et al. | 53/399 |
| 2006/0213155 | A1 * | 9/2006 | Forni et al. | 53/588 |
| 2007/0220840 | A1 * | 9/2007 | Pecchenini | 53/588 |

* cited by examiner

*Primary Examiner* — Hemant M Desai
(74) *Attorney, Agent, or Firm* — Craig A. Fieschko, Esq.; DeWitt Ross & Stevens S.C.

(57) ABSTRACT

A spool of banding material orbits a product to be banded, with the banding material unwinding from the orbiting spool and about the product to form a band about the product As the spool unwinds banding material, the shaft or other structure supporting the spool continuously urges the spool in the rewinding direction, thereby enhancing the tension on the unwinding banding material When initiating a band, gripping fingers grasp an end of the unspooled banding material and hold it adjacent the object being banded as the spool orbits the object and wraps the object and the fingers The fingers then slip out from between the object and the forming band, preferably with the assistance of a blast of pressurized air, and grasp the unspooling banding material between the spool and the banded object The length of banding material extending to the object is cut.

25 Claims, 11 Drawing Sheets

10
402
20
404
10
402
412
402G
404

20
10
402
404
10
402
404

20
10
402
404
10
402
402D
404D
404

10
402
20
404
10
402
404

10
402
20
404
10
402
404

10
402
20
404
10
402
404

10
20
10

10
20
10

BANDING OF PRODUCTS

CROSS-REFERENCE TO RELATED APPLICATIONS

This application claims priority under 35 USC §119(e) to U.S. Provisional Patent Application 61/253,539 filed Oct. 21, 2009, and also to U.S. Provisional Patent Application 61/329,296 filed Apr. 29, 2010. The entireties of these prior applications are incorporated by reference herein.

FIELD OF THE INVENTION

This document concerns an invention relating generally to the field of packaging, and more specifically to the field of applying bands about products (e.g., to hold multiple items together).

BACKGROUND OF THE INVENTION

In the packaging field, it is often desirable to apply bands about products, as where one wishes to band a stack or bundle of products into a group for ease of handling, and/or where it is desired to apply a labeled or decorative band about the circumference of one or more products. Unfortunately, the banders commonly available in the packaging field tend to be expensive and have a large number of moving parts, which decreases their reliability and increases their maintenance costs. Further, the processes and materials used by commonly available banders often tend to damage the products being banded, as where the product is so tightly wrapped that it deforms under the pressure of the band, or where the bands dig into the product. Further, the applied bands are often wrinkled, crooked, or otherwise irregular, particularly when applied at high speeds, and therefore make the banded products aesthetically displeasing to consumers.

A first example of a common banding device is the string tier, which wraps a product with twine, rope, or ribbon layers, and then ties the ends of these materials together about the wrapped product. The tendency of these materials to dig into and damage the banded product is well known. Another common banding device is the plastic strapper, which wraps a plastic (usually polyester or polyethylene) strap about a product and then joins its ends with a metal clip or a friction weld. These devices tend to suffer from the same disadvantages as the string tier, and additionally the strapping material is relatively expensive.

Paper banders are also commonly available which wrap a product with a strip of paper or plastic, and then join the ends of the strip with glue or a heat seal. Glue application often tends to soil the product being banded, and where treated papers are used to avoid the use of glue, expense is significant.

Pallet wrappers are also known which wrap products with multiple layers of stretch film. Stretch film—often formed of LLDPE (Linear Low-Density Polyethylene) and similar materials—can exhibit elasticity of as much as about 300 percent before it begins to plastically deform. Stretch film is therefore a useful material in banding and other packaging processes since it can be wound about products in tension, with the film subsequently elastically contracting to tightly surround the product. Further, glue, heat sealing, and the like are typically not needed to join ends of lengths of stretch film, since the ends of the film tend to readily adhere to other areas on the film owing to the material's inherent tackiness and/or static adhesive properties. Pallet wrappers usually include a spool of stretch film mounted on a drum which is orbited around the product to be wrapped. These devices are typically used to prepare palletized products and other large objects for shipping, and they generally do not present aesthetically pleasing bands, with the bands being necked owing to stretching, and/or wrinkled owing to slack, and are otherwise irregular about their circumferences.

The aforementioned solutions tend to be unsatisfactory where a user wishes to apply bands to easily damaged products, or to smaller products, or to a variety of different products having varying outer circumferences, particularly where it is desired to apply aesthetically pleasing bands. Once prior device that attempted to address these problems was developed by the inventor of the present invention, and was sold in 2006. This device operated in generally the same manner as an orbital pallet wrapper, but on a much smaller scale, one suitable for orbitally banding products having diameters of approximately 18 inches or smaller. Similar devices are also described in U.S. Pat. Nos. 4,850,177, 4,936,073 and 5,070,676 to Laczkowski et al. The product to be banded was situated on a support table, and a user would actuate the device to cause a spool of stretch film to orbit the product along planes adjacent to the support table. The spool was rotationally mounted at the end of an orbital arm so that the film could unwind from the spool about the product as the spool orbited the product. A brake situated between the arm and the spool resisted rotation of the spool on the arm, thereby allowing sufficient tension on the spool during unwinding that the product was tightly wrapped. The device also featured a pair of pincers that grasped an unspooled end of the spool of film next to the product to be wrapped, and held it as the spool orbited the product. After the spool made two or more revolutions about the product and returned to a location adjacent the pincers, the pincers would withdraw from between the product and the film, with the film then elastically snapping tight about the product. The pincers would then grab the film extending between the spool and the applied band and cut it, and at the same time grasp the newly-formed unspooled film end. The inventor's prior device was imperfect insofar as the film tended to irregularly stretch or go slack while wrapping about the product (particularly if the product was resting eccentrically with respect to the axis about which the spool orbited), and additionally the fingers tended to dislodge the band and/or pull out its lowermost film layer when withdrawing from between the band and the product. As a result, while the device worked well for the purpose of merely banding a stack of items together, the applied band was not entirely suitable where a neat and aesthetically pleasant band was needed.

SUMMARY OF THE INVENTION

The invention, which is defined by the claims set forth at the end of this document, is directed to banding devices and methods which offer improvements over prior devices and methods. A basic understanding of some of the features of preferred versions of the invention can be attained from a review of the following Summary of the Invention, with more details being provided elsewhere in this document. To assist in the reader's understanding, the following Summary makes reference to the accompanying drawings, which are briefly reviewed in the "Brief Description of the Drawings" section following this Summary section of this document. In these drawings, three different banding devices which exemplify the invention are shown—with FIGS. 1A-1D illustrating a first version 100, FIGS. 2A-2D illustrating a second version 200, and FIGS. 3A-3D illustrating a third version 300—and this Summary section will generally discuss features that are common to all of these exemplary banding devices, except where stated otherwise. However, for sake of clarity and simplicity, the following discussion will tend to focus primarily on the exemplary banding device 100. The reader should understand that concepts relating to any one of the devices 100, 200, and 300 (or its operation) are generally applicable to any of the other devices.

Looking initially to FIGS. 1A-1D (and particularly FIGS. 1B-1C), the exemplary banding device 100 includes a support table 102 suitable for supporting an object to be banded (shown at 10 in FIGS. 1C-1D), and a spool of banding material 20 which is rotatably situated about a spool axis (here defined by a spool shaft 104 having a spool chuck 106 whereupon the spool 20 can be engaged). The spool axis/spool shaft 104 is rotatably affixed with respect to the support table 102 (as by traveling on the rotating arm 108 of FIGS. 1B-1C) such that it—and thus the spool 20—travels in an orbital path about the support table 102. The banding material can have an end restrained adjacent the support table 102 (as by the band gripper 400, discussed in greater detail below), such that as the spool shaft 104 orbits the support table 102, the banding material rotationally unwinds from the spool 20 in a first sense (i.e., in a counterclockwise or clockwise direction) to wrap about the object 10 on the support table 102 (compare FIGS. 1C-1D). To maintain tension on the banding material as it wraps about the object 10, the spool 20 is preferably urged in a second sense opposite the first sense as the spool axis orbits the support table 102. This is preferably achieved by rotatably mounting the spool chuck 106 about the spool shaft 104, but having a clutch 110 restrain rotation of the spool chuck 106 with respect to the spool shaft 104, and then rotating the spool shaft 104 in the second sense (the direction opposite the first sense in which the spool 20 unwinds). As a result, while the spool chuck 106 and spool 20 unwind in the first sense (counterclockwise in FIGS. 1C-1D), the spool shaft 104 and clutch 110 resist such unwinding and attempt to wind the spool chuck 106 and the spool 20 in the second sense (clockwise in FIGS. 1C-1D). This "rewinding" arrangement has been found to provide substantially better band quality, with less band stretching and wrinkling about the circumference of the applied band, than in prior arrangements which only tension the band material during band wrapping via the band's resistance to unspooling from the spool 20, and/or via braking of the spool 20 to resist its rotation in the unspooling/unwinding direction.

FIGS. 1B-1D show the foregoing arrangement wherein the spool 20, spool chuck 106, clutch 110, and spool shaft 104 ride on the rotating arm 108, which is mounted to rotate about an arm rotational axis situated above the support table 102, and wherein the spool shaft 104 is rotatably connected to the rotating arm 108 at a location spaced from the arm rotational axis. In the alternative exemplary banding device 200 of FIGS. 2A-2D, the spool 20, spool chuck 206, clutch 210, and spool shaft 204 ride on a hoop 208 mounted to rotate about the support table 202, with the spool shaft 204 being driven in the sense opposite the sense in which the spool 20 unwinds as the spool shaft 204 orbits the support table 202. The driving of the spool shaft 204 is accomplished by use of a secondary hoop 212 situated about the central axis of the first hoop 208, wherein the spool shaft 204 is engaged with respect to the second hoop 212 (as by a belt 214, best seen in FIGS. 2A and 2C-2D) to be driven in the second sense as the (primary) hoop 208 rotates about the support table 202. In the alternative exemplary banding device 300 of FIGS. 3A-3C, a (preferably stationary) hoop 312 is again mounted about a support table 302, and the spool 20, spool chuck 306, and clutch 310 (FIG. 3C) are borne on a spool shaft 304 which is rotatably engaged to a carriage or secondary hoop 308 mounted to ride about the circumference of the (primary) hoop 312 in such a manner that as the spool shaft 304 orbits the support table 302, it is urged to rotate in the sense opposite the sense in which the spool 20 unwinds. A notable difference between the banding devices 100, 200, and 300 is that the banding devices 200 and 300 are "pass-through" devices wherein one may insert an object to be banded into one side of a hoop and then pass the banded object out the other side, making these devices particularly useful for high-speed and/or automated processes (e.g., along a conveyor line). In contrast, the banding device 100 is an "insert-and-withdraw" device wherein one may insert an object to be banded into a receiving enclosure above the support table 102 to band the object, and then withdraw the object from the receiving enclosure after banding in the direction opposite the direction of insertion. The banding device 100 is therefore more suitable for non-automated (or semi-automated) or occasional use.

The aforementioned band gripper 400, shown in greater detail in FIGS. 4A-4D, is used to grasp the end of the banding material at the start of wrapping about the object 10, and later release the banding material when wrapping is completed. Looking particularly to FIGS. 4A-4B, the band gripper 400 is shown as a stationary first band gripping finger 402, and a pivoting second band gripping finger 404 which can move toward and away from the first finger 402, with the band gripping fingers 402 and 404 having opposing inner gripping faces 402G/404G situated therebetween. On opposing sides of their gripping faces 402G/404G, the band gripping fingers 402 and 404 also each include a proximal finger side 402P/404P situated closer to the support table (not shown in FIGS. 4A-4D), and an opposing distal finger side 402D/404D situated more distantly from the support table. The band gripping fingers 402 and 404 are movable into, and out of, a band gripping location located adjacent to (and preferably below) the support table, and in the planes in which the spool 20 orbits the support table (and in which the banding material unwinds from the spool 20). Thus, as banding material wraps about an object on the support table, it can also wind about the band gripping fingers 402 and 404 (and more particularly, about their distal finger sides 402D/404D) if they are situated in the band gripping location. At least the first band gripping finger 402 has one or more fluid passages 406 therein which open onto its outer circumference, preferably at or adjacent to its distal finger side 402D, with the fluid passage(s) 406 being in connection with a source of pressurized gas. Additionally, a knife 408 is situated adjacent one of the first and second band gripping fingers 402 and 404 (here atop the proximal finger side 402P of the first band gripping finger 402), with the knife 408 preferably being movable into a slot 410 in or adjacent to the inner gripping face 404G of the second band gripping finger 404 when the gripping face of the second band gripping finger 404 is situated in engagement with the gripping face 402G of the first band gripping finger 402. The knife 408 can therefore cut any banding material received between the band gripping fingers 402 and 404 from their proximal finger sides.

FIGS. 5A-5L then schematically illustrate a preferred methodology by which the banding device 100 (and the banding devices 200 and 300) apply a band about an object 10 on the support table (which is not shown in FIGS. 5A-5L). For sake of simplicity, the upper images in FIGS. 5A-5L primarily show only the spool of banding material 20, the object 10 to be banded, and the band gripping fingers 402 and 404, as viewed along a plane in which the spool 20 orbits the object 10. The areas in the phantom/dashed circles of the upper images are then shown enlarged in lower images.

Initially, at the start of the banding cycle (FIG. 5A), the band gripping fingers 402 and 404 are moved into a band gripping location situated below a lower corner of the object 10 (and beneath the support table), with the stationary first band gripping finger 402 being located closer to the bottom center of the object 10 than the movable second band gripping finger 404. The spool of banding material 20 is also situated below the object 10, with an unspooled end of the banding material extending between the first and second band gripping fingers 402 and 404 from their distal finger sides 402D/404D to be gripped therebetween at the band gripping location. The band gripping face 402G of the first band gripping finger 402 is shown with an insert 412 formed of gripping media, e.g., an elastomer or other media which better grips the banding material, but the provision of gripping media on one or more of the gripping faces 402G/404G of the band gripping fingers 402 and 404 is not absolutely necessary.

The spool shaft 104 then begins orbiting about the support table in a first sense (counterclockwise in FIG. 5B), with banding material rotationally unwinding from the spool 20 while wrapping about the object 10 on the support table. Here the banding material rotationally unwinds from the spool 20 in the first/counterclockwise sense owing to the manner in which the spool 20 is installed on the spool chuck 106 and spool shaft 104, with the banding material unspooling from the side of the spool 20 facing the axis about which the spool 20 orbits. (However, the spool 20 could instead be installed on the spool chuck 106 and spool shaft 104 such that it unspools from the outside of its orbit instead, in the direction opposite the unspooling direction shown in the accompanying Figures. If this is done, the device 100 can be modified so that the spool chuck 106 is urged in the opposite direction to attain the desired rewinding force.)

FIG. 5C continues the orbit of the spool 20 about the object 10, and the unspooling of its banding material to wrap about the object 10, with slightly over one complete orbit of the object 10 being shown. The banding material has by this time completely wrapped about the object 10 on the support table, and has also wrapped about the band gripping fingers 402 and 404 at the band gripping location. Note that the first band gripping finger 402 is preferably dimensioned such that its distal finger side 402D rests further from the object 10 and the support table (not shown) than the distal finger side 404D of the second band gripping finger 404 does, and such that when the first and second band gripping fingers 402 and 404 are in the band gripping location, the unspooling banding material extends along a planar path between the corner of the object 10 and the distal finger side 402D of the first band gripping finger 402. The second band gripping finger 404 is then preferably dimensioned such that it rests within a space defined between the first band gripping finger 402, the object 10, and the banding material, with the space being sized such that the second band gripping finger 404 does not exert pressure on the banding material that would curve or otherwise deform the banding material, both when the second band gripping finger 404 is opened away from the first band gripping finger 402 and when closed against it. In effect, apart from gripping the end of the unspooled banding material, the second band gripping finger 404 does not make any substantial contact with the banding material. This lack of contact will later make it easier to withdraw the second band gripping finger 404 from between the banding material and the object 10 without dislodging or deforming the banding material.

At some desired point—preferably after two complete orbits of the spool 20 about the object 10 (and thus after the application of two layers of banding material about the object 10), when the spool 20 has returned to the position it was in at the start of the banding cycle (as shown in FIG. 5D)—the second band gripping finger 404 is moved out of engagement with the first band gripping finger 402 to release the end of the banding material unspooled from the spool 20 (FIG. 5E). Provided the first and second band gripping fingers 402 and 404 have the preferred dimensions noted earlier, the banding material is effectively only bearing tightly against the object 10 and the distal finger side 402D of the first band gripping finger 402. A burst of pressurized gas can then be emitted from the first band gripping finger 402 toward the banding material (schematically illustrated in FIG. 5F), momentarily releasing the banding material from the first band gripping finger 402. At the same time or momentarily thereafter, the first and second band gripping fingers 402 and 404 are withdrawn from the band gripping location (FIG. 5G). Owing to the elastic properties of the banding material and the tension applied to it as it was wrapped about the object 10, the banding material almost instantaneously closes on the space wherein the band gripping fingers 402 and 404 were previously situated, leaving it resting tightly about the entire circumference of the object 10 (FIG. 5H).

The band gripping fingers 402 and 404 are then moved back into the band gripping location with the second band gripping finger 404 still being in its open state away from the first band gripping finger 402. This is schematically illustrated in FIG. 5I, wherein the first band gripping finger 402 is situated between the banding material and the object 10. The second band gripping finger 404 is not shown because it is further spaced from the first band gripping finger 402 than in FIG. 5E. (In this respect, it is useful to note that the second band gripping finger 404 is preferably ordinarily biased with low force toward an open position, and must be actuated into the closed position. Thus, when the second band gripping finger 404 is opened as in FIGS. 5E-5F, it rests against the banding material with very low force, and then swings further open when withdrawn from the band gripping location, hence its absence from FIG. 5I.)

In FIG. 5J, the second band gripping finger 404 is then moved back into engagement with the first band gripping finger 402, thereby grasping the banding material between the gripping faces of the band gripping fingers 402 and 404. The knife 408 is then actuated to cut the banding material between the band gripping location and the object 10 (FIG. 5K), thereby severing the unspooling banding material from the banded object 10, while at the same time creating a grasped end of unspooled banding material between the band gripping fingers 402 and 404 (as in FIG. 5A). If desired, the severed end of the banding material resting adjacent the banded object 10 may be affirmatively sealed to the remainder of the band about the object 10, as by moving a heated and/or vibrating press 414 onto or adjacent the severed end, by emitting heated gas and/or infrared energy onto or adjacent to the severed end, or by otherwise supplying sealing energy at or adjacent the severed end. FIG. 5L then shows the spool 20 and band gripping fingers 402 and 404 restored to the state they were in at the beginning of the cycle (in FIG. 5A), ready to band another object 10 once the already-banded object 10 is moved from the support table.

It is preferred that the band gripping fingers 402 and 404 (and thus the band gripping location at which the banding cycle starts) be situated in a position such as (or similar to) that of FIGS. 5A-5L, which is beneath the support table, and beneath and closely adjacent to the corner of the object 10 about which the spool 20 passes when first moving beneath the object 10. Situating the band gripping fingers 402 and 404 at this location will tend to cut the banding material in close proximity to the object 10, with only a small length of banding material extending from the object 10 to the band gripping fingers 402 and 404, and therefore only a very small "tail" of banding material (if any) will extend from the band once the banding material is cut. Since the devices 100, 200, and 300 may need to band objects 10 of different sizes at different times, it is useful to have the band gripping fingers 402 and 404 be movable beneath the support table along planes parallel to the plane in which the spool 20 orbits, thereby allowing the band gripping fingers 402 and 404 to be relocated to the preferred position. FIG. 3D illustrates an arrangement of this nature for the banding device 300, wherein the first and second band gripping fingers 402 and 404 of the band gripper 400 are situated on a gripper carriage 416 translatably affixed with respect to the support table on a rail 418, such that the gripper carriage 416 and the first and second band gripping fingers 402 and 404 may translate about the underside of the support table to a desired band gripping location in relation to the corner of the object 10.

FIG. 3D also illustrates an optional registration member 500 situated above a support table 302—more particularly above the (phantom) front entry section 302E of the support table 302—and having a side edge 502 oriented at least substantially parallel to the axes about which the spool, etc. rotate. Assuming a box-like object is to be wrapped, a user can simply slide the object atop the front entry section 302E and along the side edge 502 of the registration member 500 until it is situated along the plane in which the spool 20 orbits, at which point the object may then be banded. The registration member 500 is preferably translatable across the support table 302 to a desired location, preferably one such that when an edge of the object to be wrapped is situated against the side edge 502 of the registration member 500, the object will be at least approximately centered on the support table 302 with respect to the axis about which the spool 20 orbits. Positioning the object in this manner can assist with improved band quality. Preferably, the registration member 500 is connected to the band gripper 400 such that relocation of the registration member 500 to a desired location also automatically relocates the band gripper 400 to the aforementioned preferred band gripping location (slightly inside the corner of the object to be wrapped).

Also shown in FIG. 3D is an exemplary version of an optional feature which is useful in cases where the object to be banded is deformable. If the object is deformable—e.g., a thin textile or paper product, such as a shirt or a small stack of papers—the tension of the banding material during banding may squeeze the object, causing it to at least partially deform or collapse. To deter this, at least one band support member 600—which may resemble the first band gripping finger 402—may be provided which is movable into, and out of, a band support location located adjacent to the support table 302, and in planes in which the banding material unwinds from the spool 20, most preferably at or adjacent one or more of the lower corners of the object. Thus, when a band support member 600 is actuated to move into the band support location (preferably at or around the beginning of the banding cycle, as in FIG. 5A), the banding material wraps about the band support member 600, as well as about the object and the band gripping fingers 402 and 404. Because the band support member(s) 600 help support the band near one or more of the opposing lateral edges of the object, they help deter the band from constricting about the object to such a degree that the object deforms. Once the object has been banded (e.g., at or after the step shown in FIG. 5J), the band support member 600 may be withdrawn from the band support location by retracting it, e.g., in a manner similar to the first band gripping finger 402, or more preferably by simply pivoting it in a direction toward the center of the support table 302 along a plane oriented at least substantially parallel to the support table 302. As with the aforementioned gripper carriage 416 and registration member 500, the band support member 600 is preferably situated on a band support carriage 602 which is translatably affixed with respect to the support table 302. Thus, the band support carriage 602 may translate along planes parallel to the support table 302 to a desired location adjacent a corner of the object, from which the band support member 600 may translate, pivot, or otherwise move into (and out of) the band support location.

Further advantages, features, and objects of the foregoing and other versions of the invention will be apparent from the remainder of this document in conjunction with the associated drawings.

BRIEF DESCRIPTION OF THE DRAWINGS

In the drawings, all of which present perspective views save for the schematic views of FIGS. 5A-5L.

DETAILED DESCRIPTION OF PREFERRED VERSIONS OF THE INVENTION

Figure 1A:
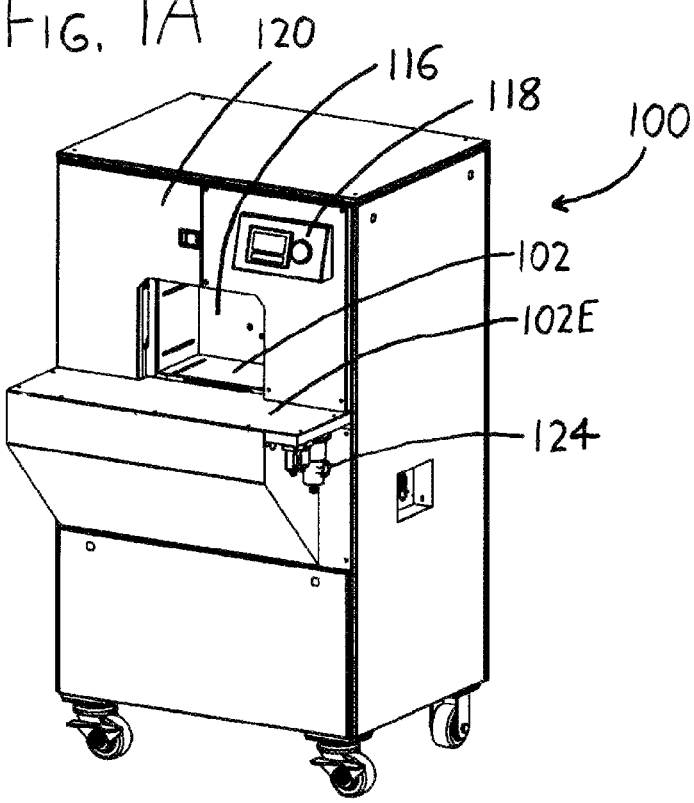
FIG. 1A illustrates a first exemplary banding device 100, showing a receiving enclosure 116 into which an object to be banded can be inserted, wherein the object is supported on a support table 102 therein (and on an adjacent support table entry section 102E), and is banded upon actuation of the controls 118.

The following discussion will expand on the matters noted in the foregoing Summary of the Invention section of this document. However, before doing so, it is initially useful to clarify some of the terminology used in this document.

Throughout this document, reference is occasionally made to rotational motion of multiple components in "counterclockwise" and "clockwise" senses (directions). Where these terms are used, it should be understood that the rotational motion of the components is considered from the same point of observation: in other words, where a first component is said to rotate clockwise and a second component is said to rotate counterclockwise, it should be understood that the first component rotates in the opposite sense (i.e., in the opposite rotational direction) with respect to the second component. Thus, where the terms "clockwise" and "counterclockwise" are used to characterize the motion of multiple components, they serve to define the motion of the components relative to each other. At the same time, it should be understood that the terms "clockwise" and "counterclockwise" are ambiguous when used to refer to the motion of any single component, since (for example) a clockwise-rotating component could instead be regarded as rotating counterclockwise when viewed along its axis of rotation from the opposite side of the component. In short, it should be understood that any reference to clockwise motion can instead be regarded as counterclockwise motion, so long as the directions of rotation of all other noted components are also reversed.

Also, throughout this document, when it is stated that a spool, hoop, or other structure orbits the support table, this should be understood as meaning that the spool or other structure rotates about the support table, and/or about a location adjacent an edge of the support table, such that banding material wound about the spool can be unwound about an object resting on the support table as the spool travels along its orbital path. In other words, the matter being orbited need not rest within the plane in which the structure orbits, and the matter could instead rest partially within or closely adjacent to the plane.

The exemplary band gripper 400 discussed above will now be discussed in greater detail with reference to FIGS. 4A-4D. As previously noted, the band gripping fingers 402 and 404 are movable into and out of a band gripping location which is preferably located as shown in FIGS. 5A-5F and 5I-5L, and the pivoting second band gripping finger 404 can also pivot toward the stationary first band gripping finger 402 so that the gripping fingers 402 and 404 may engage banding material at their inner gripping faces 402G/404G. FIG. 4A provides a more detailed depiction of the exemplary arrangement used to achieve these actions in the banding devices 100, 200, and 300. A somewhat square-shaped finger carriage anchor 420, which remains stationary during operation of the devices 100, 200, and 300, may be attached to surrounding structure (for example, in FIG. 3D, to a gripper carriage 416 which translates across the rail 418, with the rail 418 having its opposing sides affixed to the inside of the cabinet 320 of the device 300). A finger carriage 422 is then defined as a somewhat rectangular member having a central aperture wherein the finger carriage anchor 420 is fit. The finger carriage anchor 420 bears linear actuators (e.g., pneumatic, electric, or hydraulic solenoids) which are engaged to the finger carriage 422, and which can push the finger carriage 422 forwardly (as shown in FIG. 4A) into the band gripping location, or which can retract the finger carriage 422 rearwardly out of the band gripping location. A knife actuator 424 is then provided on the finger carriage 422 to rotate the knife 408 about pivot 426 when desired, and a second finger actuator may be actuated to rotate the second band gripping finger 404 about pivot 428 when desired. Thus, the finger carriage 422 may carry the band gripping fingers 402 and 404 into and out of the band gripping location, and may open and close the band gripping fingers 402 and 404 when desired.

Figure 4A:
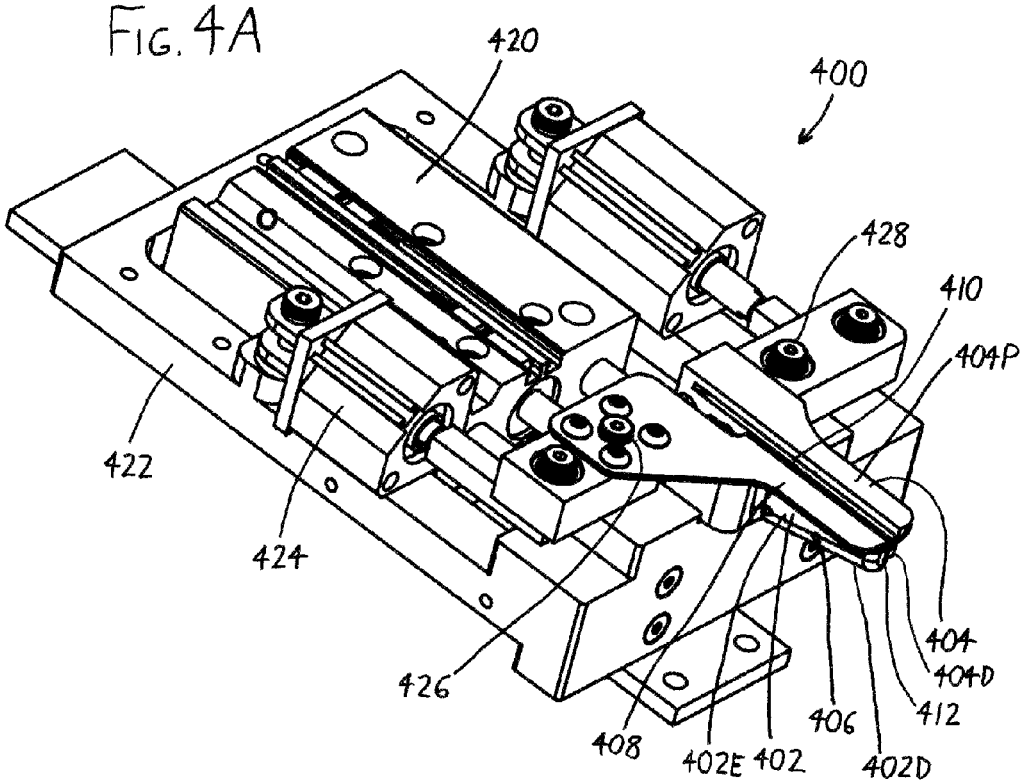
FIG. 4A shows the band gripper 400 and band gripping fingers 402 and 404 of FIGS. 1B-1D, 2B-2C, and 3D in greater detail, with the band gripping fingers 402 and 404 being shown closed.
Figure 4B:
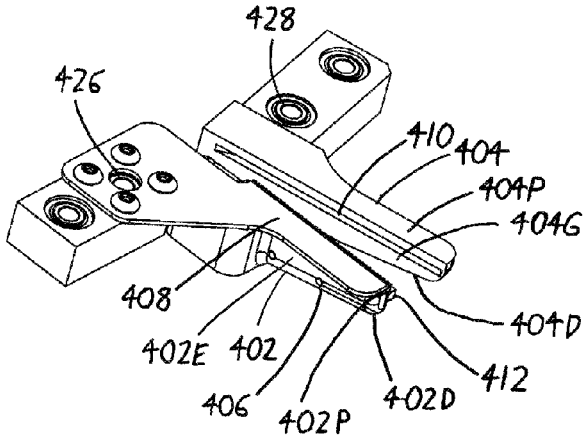
FIG. 4B illustrates the band gripping fingers 402 and 404 of FIG. 4A in an open state from their tops.
Figure 4C:
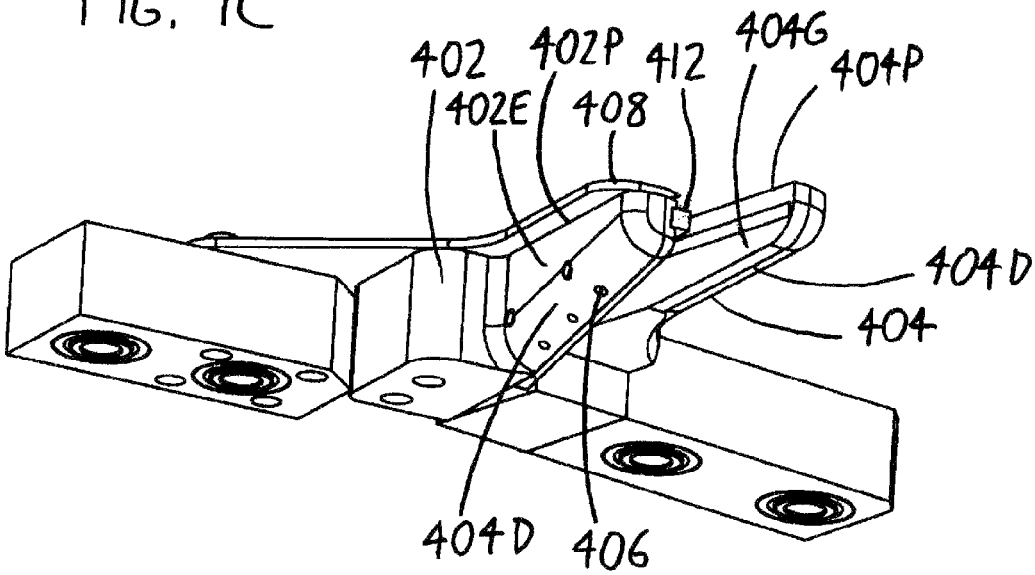
FIGS. 4C and 4D then illustrate the bottoms of the band gripping fingers 402 and 404 of FIG. 4B from different orientations.
Figure 4D:
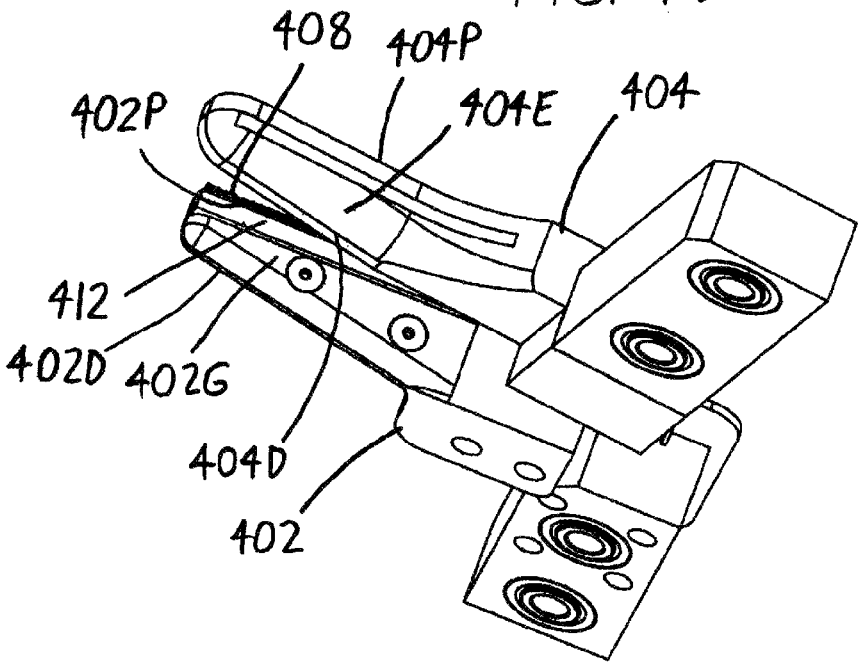
Figures 5A, 5B, 5C, 5D:
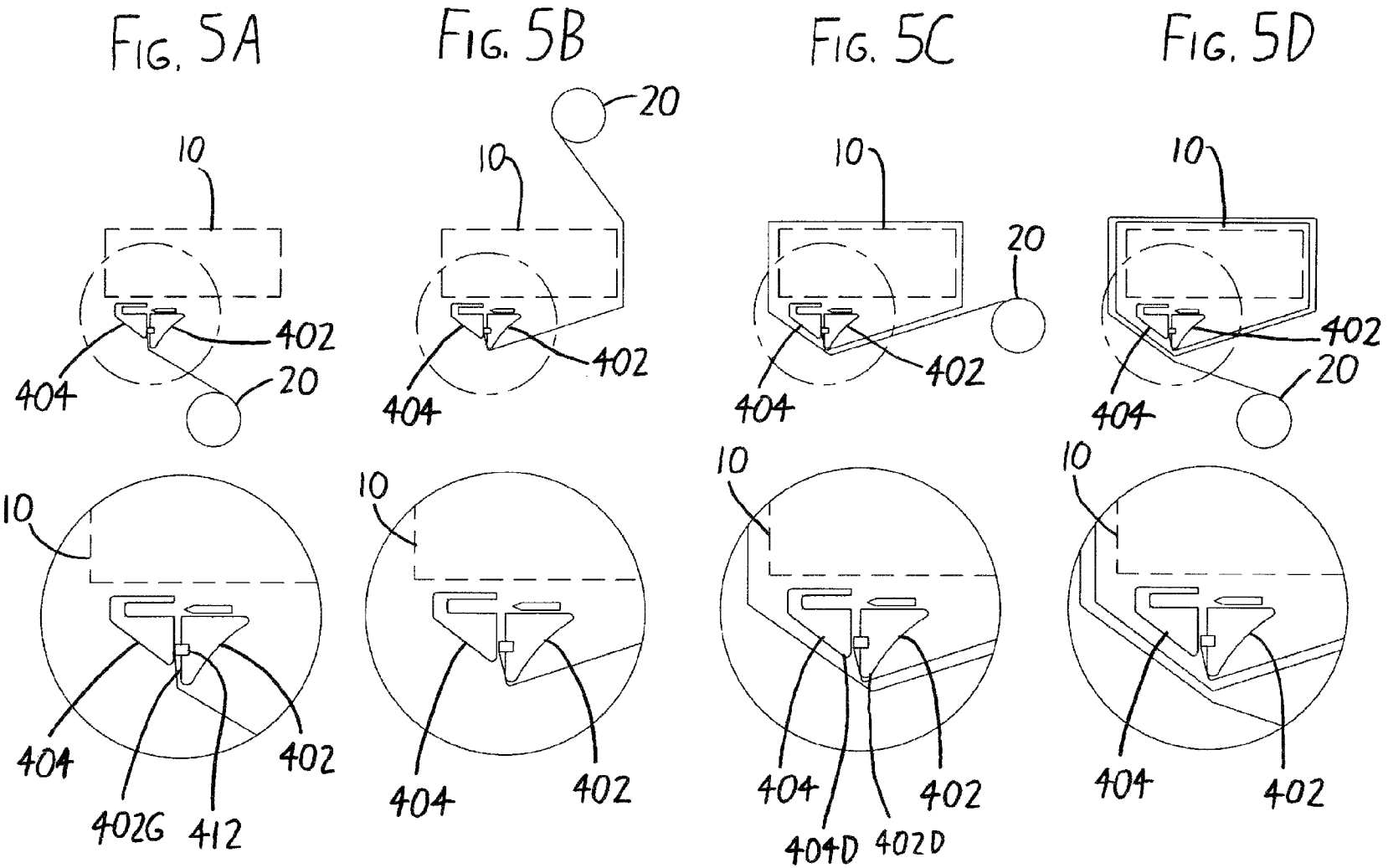
FIGS. 5A-5L contain upper views schematically showing the banding of an object 10 along a plane in which the banding material unwinds from the spool 20, with the spool orbiting the object 10, and also showing the banding material's interaction with the band gripping fingers 402 and 404 (which is further depicted in lower magnified views beneath the upper views).
Figures 5E, 5F, 5G, 5H:
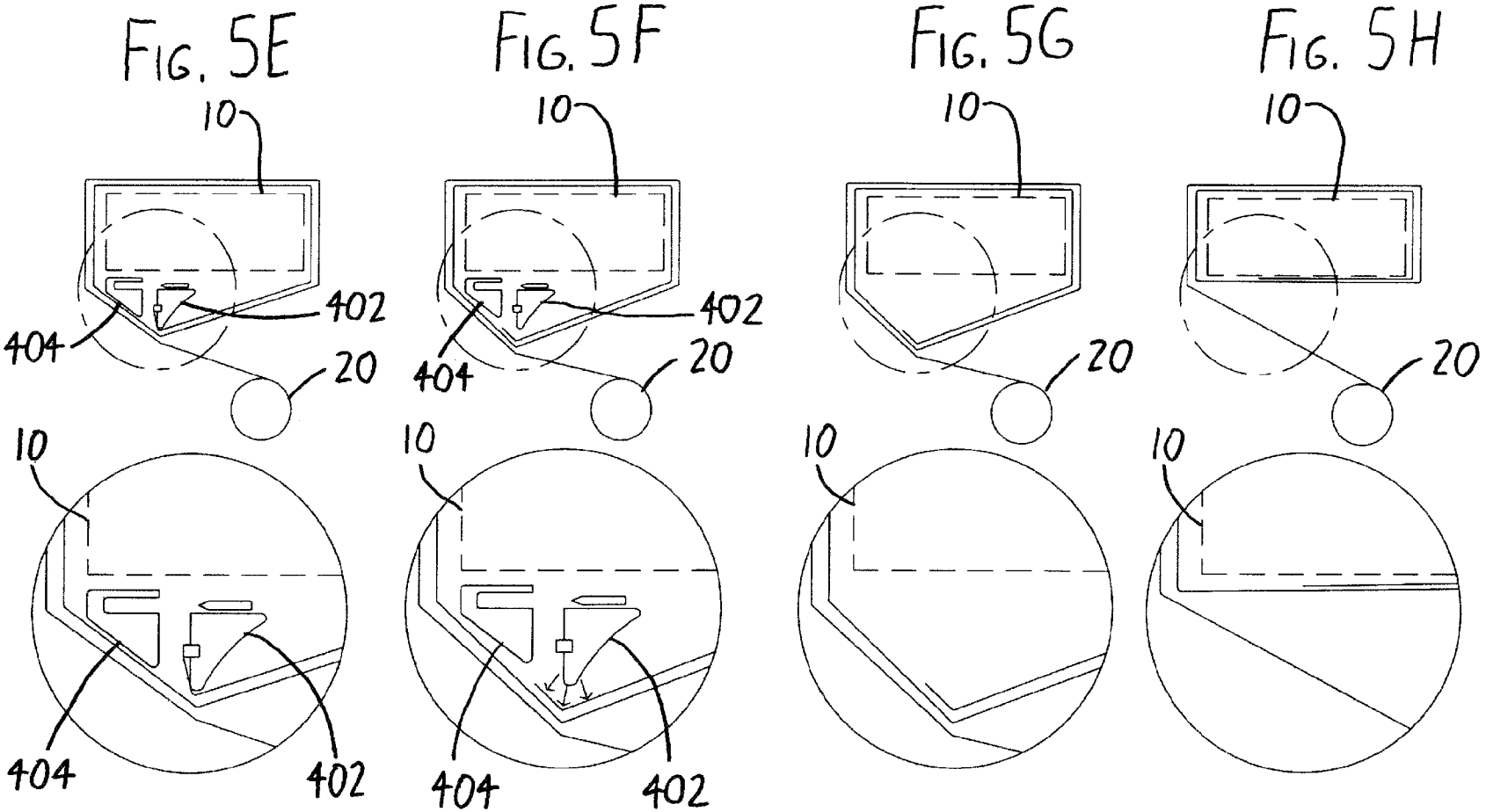
Figures 5I, 5J, 5K, 5L:
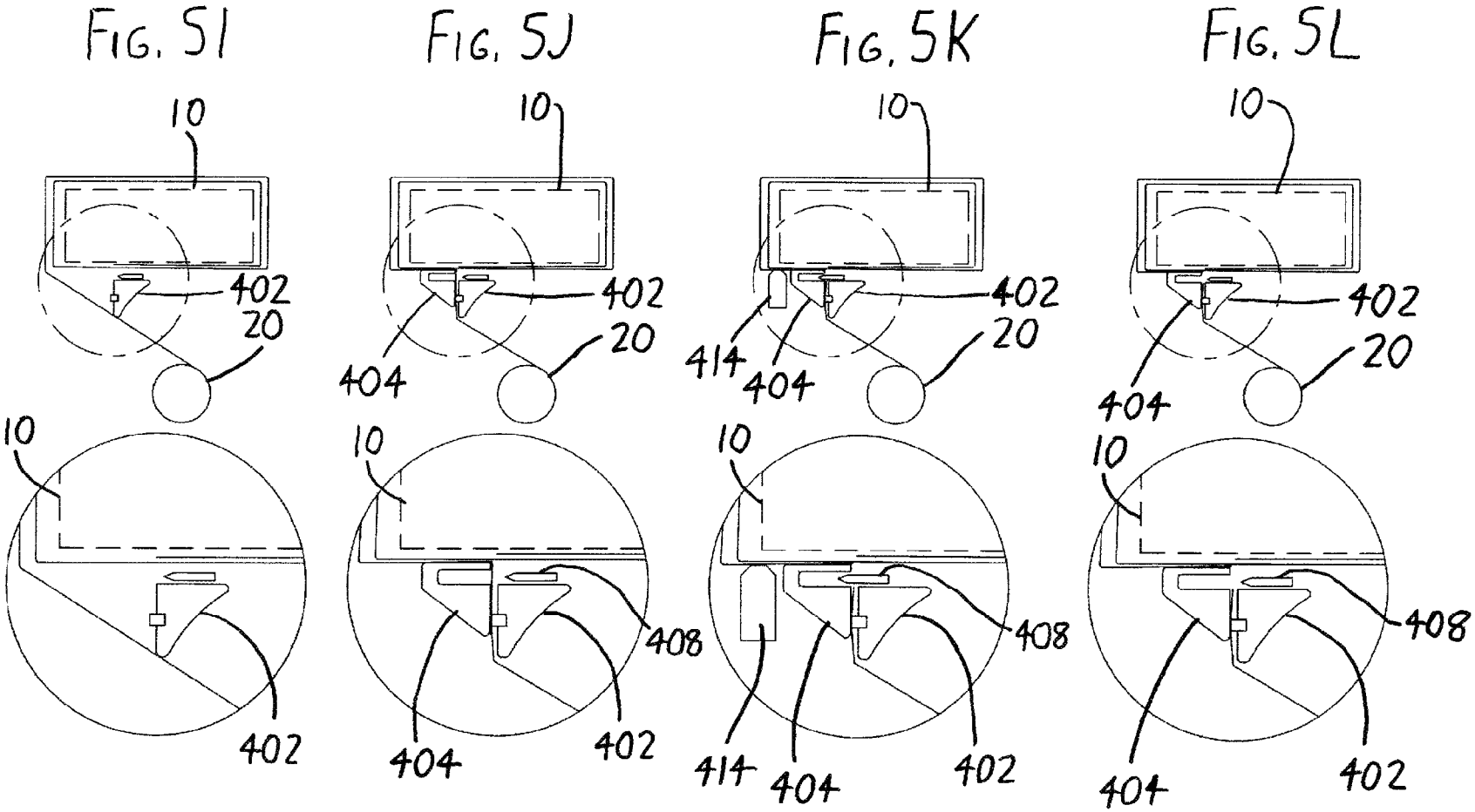

FIGS. 4B-4D then provide a more detailed depiction of the proximal finger sides 402P/404P and the distal finger sides 402D/404D of the first and second band gripping fingers 402 and 404. The (pivotable) second band gripping finger 404 has a shape which is best understood by reviewing FIGS. 5A-5F and 5I-5L in conjunction with FIGS. 4A-4D. Looking first to FIGS. 5A-5F and 5I-5L, the second band gripping finger 404 has a somewhat triangular cross-section, and as then seen in FIG. 4B, this cross-section decreases in size as the second band gripping finger 404 extends away from the finger carriage 422, with the distal finger side 404D of the second band gripping finger 404 sloping upwardly as it extends away from the finger carriage 422. As FIG. 4B further shows, the second band gripping finger 404 also has an outer side 404E which slopes inwardly (towards the inner gripping face 404G) as the second band gripping finger 404 extends away from the finger carriage 422. The sloped distal finger side 404D and outer side 404E allow easier withdrawal of the band gripping fingers 402 and 404 from between the banding material and the object being banded. FIG. 4D then illustrates how the slot 410 in the second band gripping finger 404 which receives the knife 408 extends through the second band gripping finger 404 from its inner gripping face 404G to its outer face 404E. The slot 410 is useful to assist the cutting action of the knife 408 by creating a shearing effect in banding material, and the slot 410 additionally provides some degree of protection to a user during routine maintenance and the like by partially covering the knife 408 when it is actuated.

The first band gripping finger 402, which is rigidly mounted to the finger carriage 422, then has a somewhat similar configuration insofar as its outer side 402E slopes toward its inner gripping face 402G as the first band gripping finger 402 extends away from the finger carriage 422, and its distal finger side 402D slopes toward its proximal finger side 402P as well. The distal finger side 402D of the first band gripping finger 402, perhaps best seen in FIGS. 4A-4B, is preferably gently convexly curved between the inner gripping face 402G and the opposing outer finger side 402E so that the first band gripping finger 402 does not present sharp edges to banding material wrapped about the distal finger side 402D in the manner shown in FIGS. 5A-5L. FIG. 4C clearly illustrates the passages 406 for emitting pressurized gas, to allow low-friction disengagement of the distal finger side 402D from the banding material.

The first version of the banding device 100 will now be discussed in greater detail with reference to FIGS. 1A-1D. FIG. 1A illustrates the finished banding device 100, with the spool 20, spool chuck 106, spool shaft 104, clutch 110, arm 108, etc. enclosed within a cabinet 120 (which bears a fitting 124 for a pneumatic supply, if pneumatic power is used). To operate the device, the user takes an object to be banded, places it on the entry section 102E of the support table 102, and slides the object rearwardly to situate it in alignment with the space between the support table entry section 102E and the remainder of the support table 102. This space, which is best seen in FIGS. 1C-1D, coincides with the planes in which the spool 20 orbits the support table 102, and in which the banding material unspools from the spool 20 to wind about an object 10. If desired, the side (and perhaps rear) wall of the receiving enclosure 116 can be made movable to define registration edges against which an object 10 to be banded can be aligned to better orient and hold it at a desired location/orientation. The user can then utilize the controls 118 to actuate the steps shown in FIGS. 5A-5L, thereby banding the object 10. The controls 118 preferably communicate with a programmable logic controller (not shown) to allow the user to select the number of revolutions that the spool 20 will travel about the object 10 (i.e., the number of layers of banding that will be applied to the object 10). Once the object 10 is banded, the user can withdraw the banded object 10 from the receiving enclosure 116, and may insert another object 10 to be banded and again activate the controls 118 to initiate banding.

The controls 118 can also include features such as counting of the number of objects wrapped, fault warnings (e.g., indicating errors in the location of the arm 108/spool 20, the band gripping fingers 402 and 404, the panels of the cabinet 120, etc.), an indication of when a spool 20 of banding material is nearly exhausted and requires replacement, controls for initiating the installation of a new spool 20, etc. A useful feature of the banding device 100 of FIGS. 1A-1D is that when a spool 20 of banding material is exhausted, or nearly so (i.e., when all or nearly all banding material has been unspooled from the spool 20 and applied to objects), installing another spool 20 is exceedingly fast and easy. A user can indicate on the control panel that the spool 20 is to be changed, and the arm 108 rotates to rest at a position such as that shown in FIG. 1D. The user can open the front panels of the cabinet 120 and install another spool 20 on the spool chuck 106, and hold onto an unspooled end of the banding material (either inside or outside the cabinet 120), preferably at a position slightly to the left of the orbit of the spool 20 in FIG. 1D. Via the control panel 118, the user can then instruct the device 100 to move to the cycle start state shown in FIG. 5A: the spool 20 will continue its orbit by approximately 90 degrees until it encounters the band gripping fingers 402 and 404 in the band gripping location. The band gripping fingers 402 and 404 can then perform a process similar to that shown in FIGS. 5D-5L (save that the collapse of the band shown in FIGS. 5G-5H does not occur, since there is no band), ending with the held length of unspooled banding material being cut off, and the end of the banding material being grasped between the band gripping fingers 402 and 404 as in FIG. 5A.

Figure 1B:
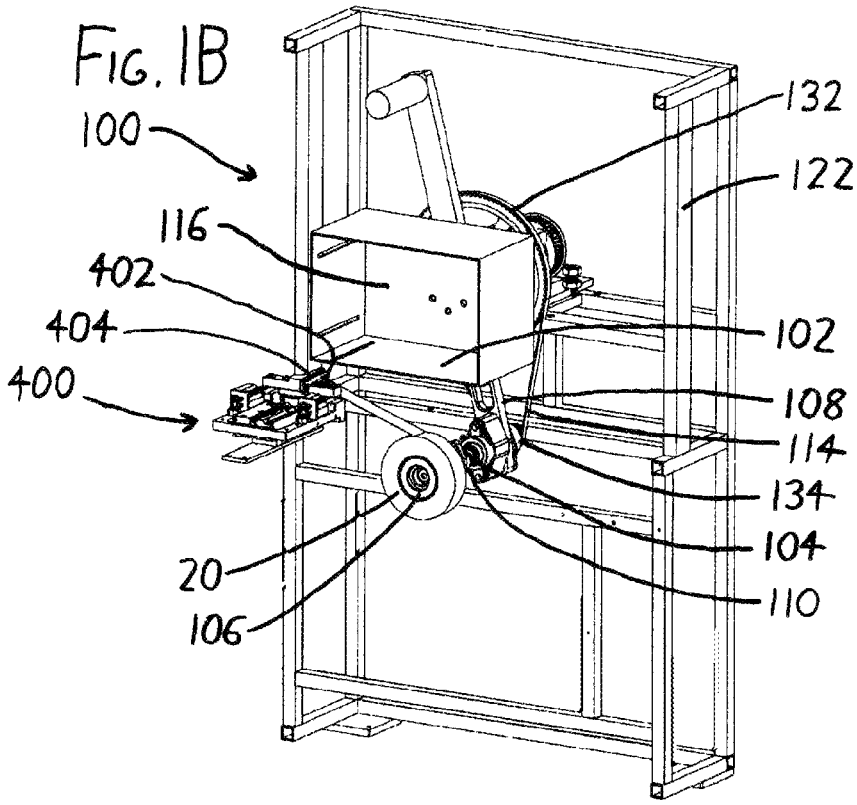
FIG. 1B illustrates the banding device 100 of FIG. 1A, with the cabinet 120, support table entry section 102E, controls 118, and associated components of FIG. 1A removed (as well as portions of the internal framework 122 of the device 100), and showing the spool of banding material 20 on the rotating arm 108 ready to orbit about the receiving enclosure 116 and support table 102, with an unspooled end of the spool 20 of the banding material being held at the band gripper 400.
Figure 1C:
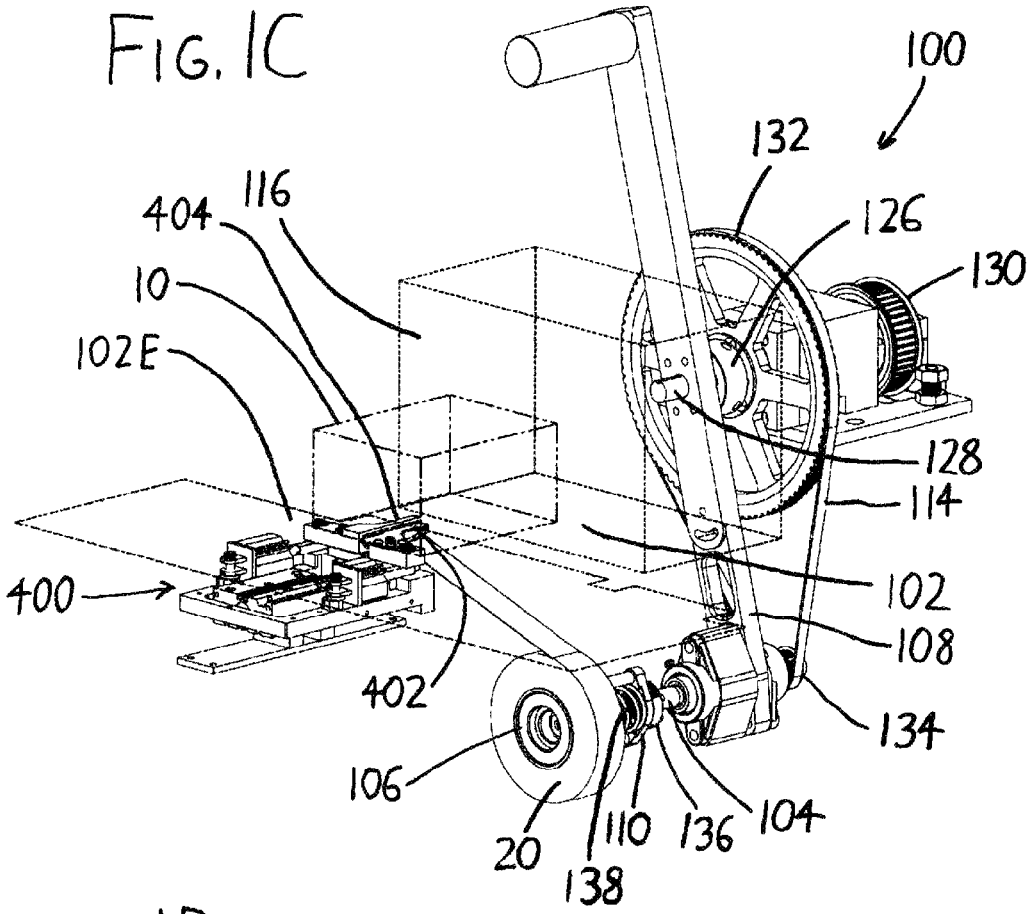
FIG. 1C illustrates the components of FIG. 1B in greater detail with the internal framework 122 of the banding device 100 removed, and with the support table 102, receiving enclosure 116, and support table entry section 102E being shown in phantom along with an exemplary object 10 to be wrapped (also shown in phantom).
Figure 1D:
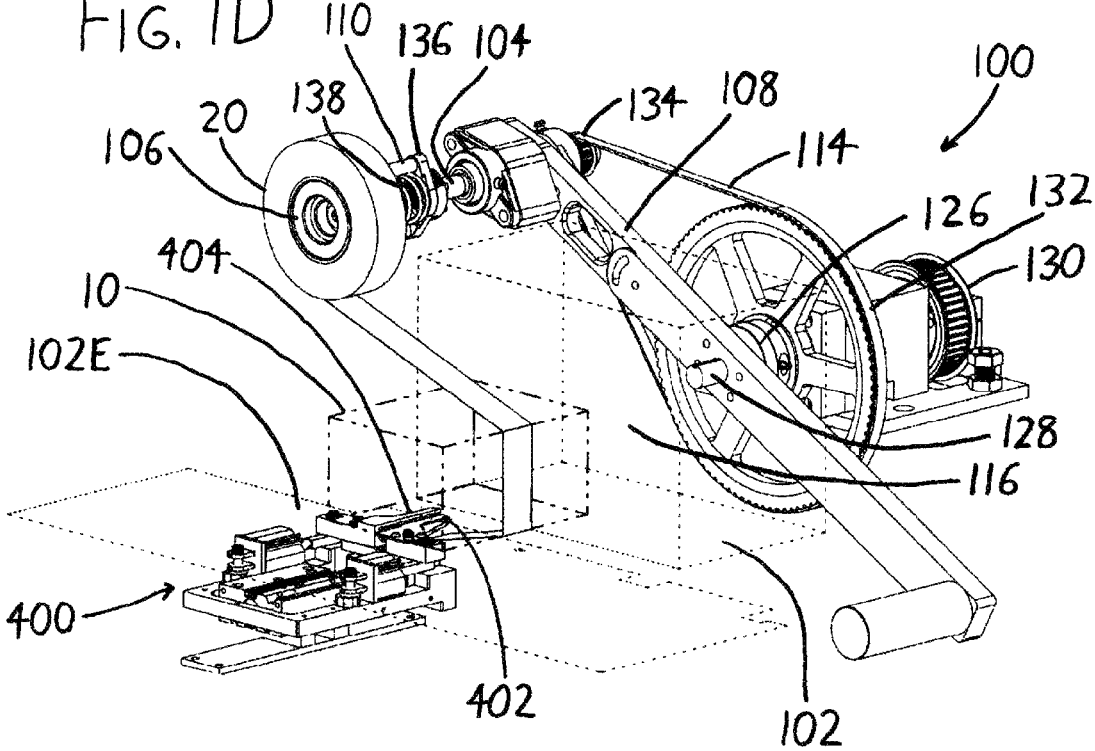
FIG. 1D illustrates the arrangement of FIG. 1C shortly after the banding process has been initiated, with the rotating arm 108 orbiting the object 10 in a counterclockwise sense as the spool 20 unwinds banding material about the object 10 (also in the counterclockwise sense), and with the spool shaft 104 simultaneously urging the spool 20 in the clockwise sense.

Turning now to FIGS. 1B-1D, and particularly FIGS. 1C-1D, the rotating arm 108 is actuated in the following manner. A tubular outer arm shaft 126 is rotatably mounted about an inner shaft 128, and bears the rotating arm 108 at its end. A motor 130, e.g., a conventional AC three-phase motor (preferably with built-in brake), rotationally drives the outer arm shaft 126 about the inner shaft 128 to in turn rotate the arm 108. (Technically, the item 130 depicted in the drawings is a wheel driven by an unshown motor via an unshown belt, but if desired, the motor could be placed at 130.) A stationary pulley 132 is mounted to the housing of the motor 130 concentrically about the arm shaft 126, such that the arm shaft 126 rotates within the stationary pulley 132 and about the axis of the stationary pulley 132. The spool shaft 104 is then rotatably mounted near the end of the arm 108, and it bears a spool shaft pulley 134 operationally linked to the stationary pulley 132 via a belt 114 in such a manner that the spool shaft 104 is driven in the sense opposite that in which the arm 108 rotates (and in which the spool 20 unspools banding material during the banding operation). The gear ratio between the arm shaft 126 and the spool shaft 104 is preferably such that for every rotation of the arm shaft 126, there will always be greater than one rotation of the spool shaft 104 (i.e., the spool shaft 104 will always attempt to rewind the spool 20 faster than the banding material can be unspooled). Other power transmission arrangements could be used instead of the illustrated pulley and belt arrangements, such as chain and sprocket arrangements, gearing, etc., but the pulley arrangement is beneficially inexpensive and easily maintained. Sensors (e.g., rotary encoders, tooth-counting proximity switches, etc.) can be used to count rotations of the arm 108, the spool shaft 104, and other components, and can supply these measurements to the programmable logic controller (or other controls) for use in control schemes, fault detection, and other functions.

The spool chuck 106 is rotatably mounted on the spool shaft 104 near the end of the spool shaft 104 opposite the spool shaft pulley 134. The spool chuck 106 is not illustrated in detail in the drawings, but it can take the form of any suitable chuck known in the art which engages a spool 20 mounted thereon. A simple preferred version of the chuck 106 provides a cylinder with spring-loaded pins on its outer diameter, whereby the pins retract outside the inner circumference of a spool 20 as the spool 20 is loaded on the cylinder, and the pins can then extend to frictionally or otherwise engage the inner circumference of the spool 20. Cam locks, threaded tapers, or other arrangements can then be used to lock the pins in their extended state if desired.

The clutch 110 is then affixed to the spool shaft 104 next to the spool chuck 106. The clutch 110 includes a clutch base 136 which is adjustably mounted on the spool shaft 104 such that it may translate along the length of the spool shaft 104 to be affixed at a desired location, and one or more clutch springs 138 extend from the clutch base 136 to a brake pad (not shown) which bears against the spool chuck 106. Thus, moving the clutch base 136 toward the spool chuck 106 compresses the clutch spring 138 and increases the braking force on the spool chuck 106, whereas moving the clutch base 136 away from the spool chuck 106 decreases braking force.

The end result of the foregoing arrangement is that as the arm 108 rotates, the spool of banding material 20 (and its spool chuck 106) rotates about the spool shaft 104 in the same sense as the banding material unspooling from the spool 20. However, at the same time the spool shaft 104 (and its clutch 110) act against the spool chuck 106 to exert a spooling/rewinding force in the opposite sense, thereby increasing the tension on the unspooling banding material. This tension is a function of the dynamic friction exerted by the clutch 110 against the spool chuck 106, and tends to be more uniform than where no spooling/rewinding force is used. More importantly, banding material tension tends to be more uniform regardless of the geometry of the object being banded. The uniform tension leads to more consistent banding of objects about their circumferences, with less slack (and thus wrinkling) of the banding material applied to the object, and/or stretching (and thus necking) of the banding material applied to the object, and thus more uniform and aesthetically pleasing bands.

The rewinding force urging the spool 20 in the rewinding direction while unwinding banding material can be provided by arrangements other than the one described. As an example, a servomotor or other actuator could drive the spool shaft 104 in a direction opposing the unwinding of the spool 20 (and an arrangement of this nature will be discussed below in relation to FIG. 2D). However, the aforementioned arrangement is inexpensive, robust, and simply controlled, and has proven to be surprisingly effective in practice.

The second version of the banding device 200 will now be discussed with reference to FIGS. 2A-2D. Looking first to FIG. 2A, the support table 202 is depicted with simple conveyor belts 244 to convey the object 10 to be banded through the rotating hoop 208, and into the plane in which the spool 20 (carried on the hoop 208) dispenses banding material. Turning then to FIGS. 2B-2C, the rotating hoop 208 is supported on rollers 246 to orbit the support table 202, and is driven by a belt 248 operatively linked to a motor 230. The spool shaft 204 is rotationally mounted on the rotating hoop 208 and carries a spool shaft pulley 234 (FIG. 2D), clutch 210, and spool chuck 206 (and thus the spool 20), which operate in substantially the same manner as those in the banding device 100. A stationary second hoop 212 is mounted about the support table 202 adjacent the rotating hoop 208, and the spool shaft pulley 234 (and thus the spool shaft 204) is operationally linked to the second hoop 212 via a belt 214. As with the first banding device 100, as the first hoop 208 orbits the support table 202, the spool shaft 204 is driven in the direction opposing the unwinding of the spool 20 (and preferably at a rate exceeding the rate at which the banding material is unwound from the spool 20). FIGS. 2B and 2C, which are somewhat analogous to FIGS. 1C and 1D, then illustrate steps in the banding of an object 10.

Figure 2A:
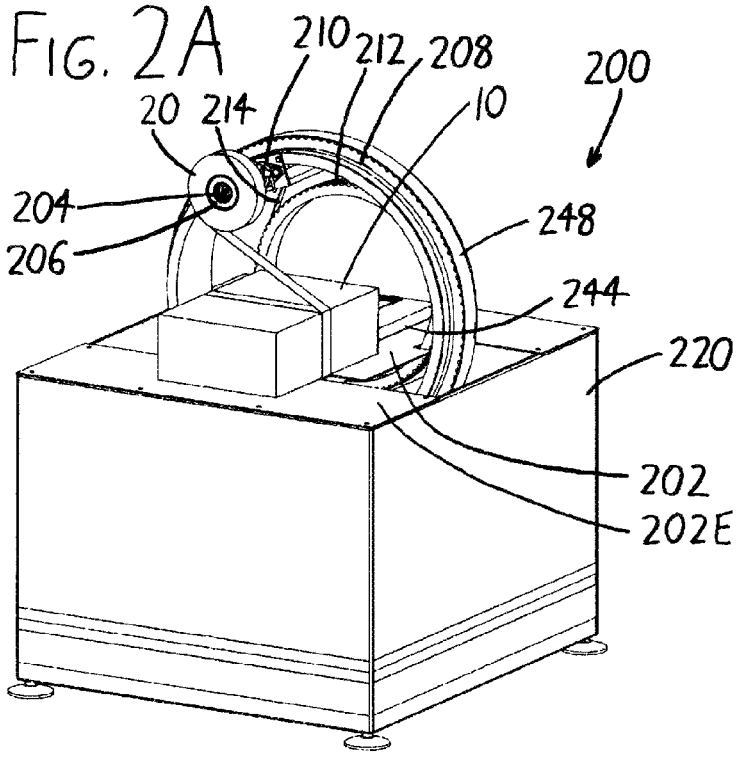
FIG. 2A illustrates a second exemplary banding device 200, wherein a rotating hoop 208 bearing the spool shaft 204 and the spool of banding material 20 orbits the support table 202 to apply banding material to an object 10.
Figure 2B:
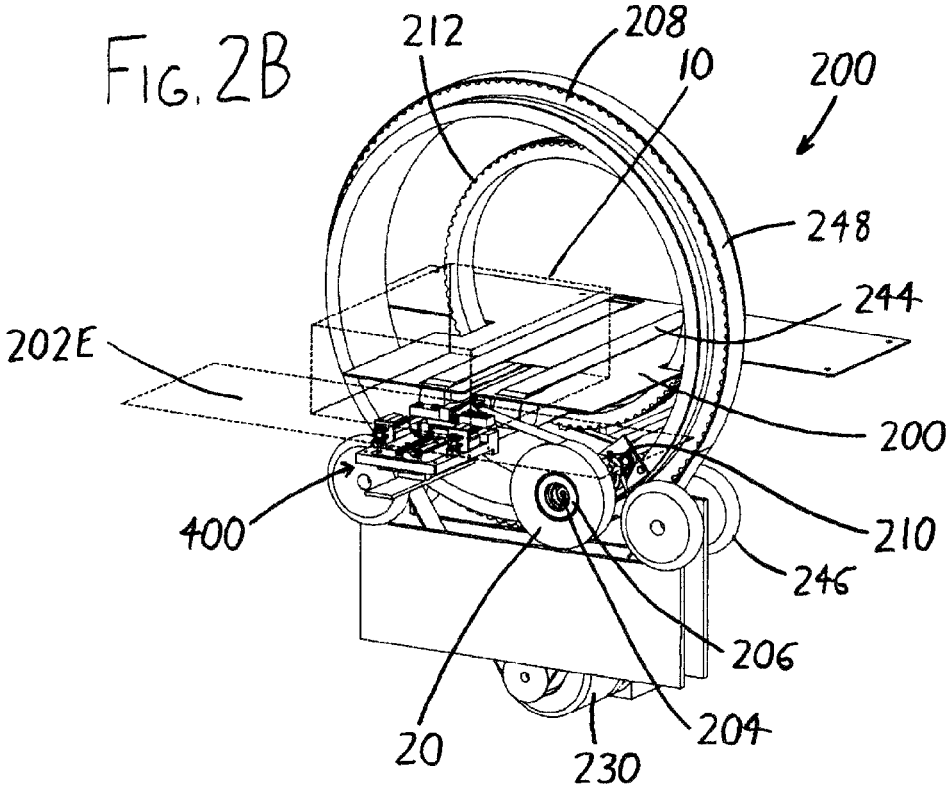
FIG. 2B is a view of the banding device 200 analogous to the view of the first banding device 100 in FIG. 1C, showing the cabinet 220 and selected other components of FIG. 2A removed, and with the object 10 to be banded being shown in phantom within the hoop 208 atop the support table 202 (with its support table entry section 202E being shown in phantom), and with the spool of banding material 20 being ready to orbitally travel with the hoop 208 about the object 10 to apply banding material to the object 10 along the space between the support table entry section 202E and the remainder of the support table 202.
Figure 2C:
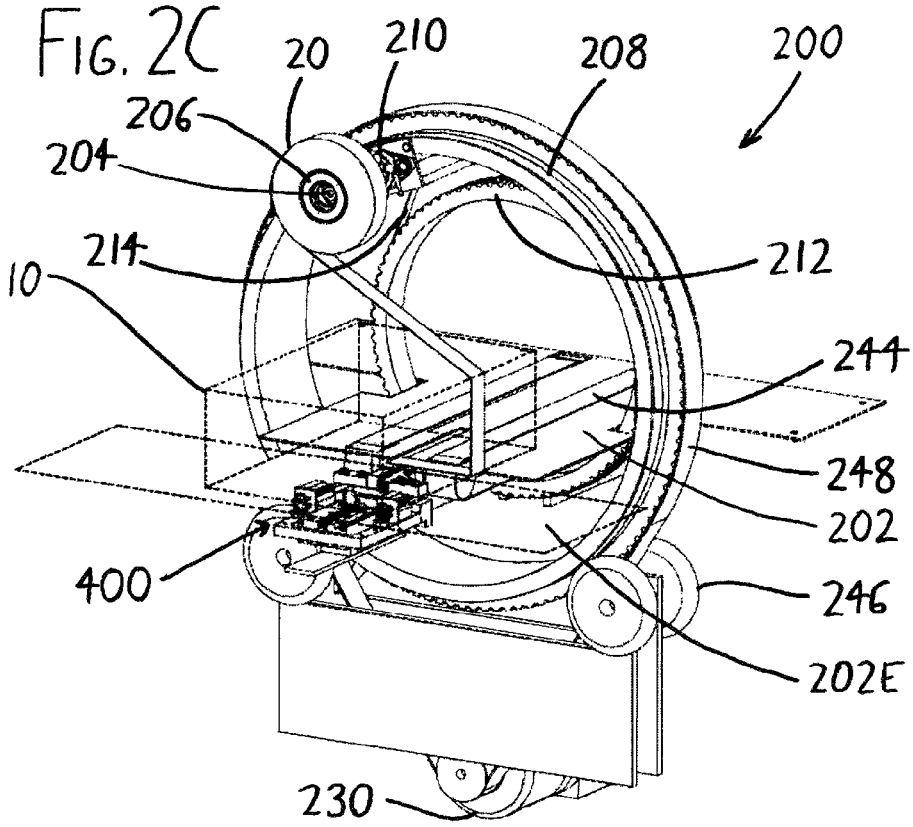
FIG. 2C is a view of the banding device 200 analogous to the view of the first banding device 100 in FIG. 1D, showing the arrangement of FIG. 2B after further rotation of the hoop 208, with the banding material being shown partially wrapped about the object 10.
Figure 2D:
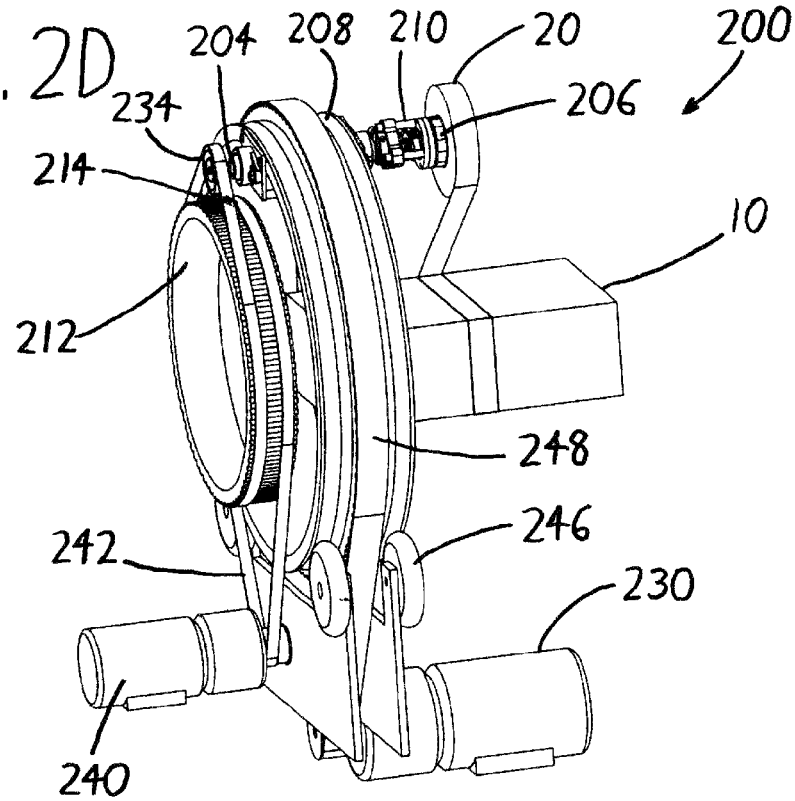
FIG. 2D then shows an alternative version of the arrangement of FIGS. 2B-2C, wherein the secondary hoop 212 used to drive the spool shaft 204 is itself rotationally supported and driven by a motor to allow adjustment of the rewinding force applied to the spool 20.

FIG. 2D then illustrates a variant of the arrangement of FIGS. 2A-2C wherein the second hoop 212 is rotationally driven (if desired) rather than remaining in a stationary state. The second hoop 212—which is shown without the bearings which rotationally support it—is driven by a second drive motor 240 and belt 242, which can be used to drive the second hoop 212 to adjust the rewinding force as desired. It is notable that if the circumferences of objects to be banded are known and repeatable, the second drive motor 240 could even be controlled to adjust tension in the banding material as desired as banding material is applied about the objects. For example, a rewinding force might be applied to highly tension the banding material about part of an object's circumference, and then little or no force (or even an unwinding force) might be applied to the banding material about other portions of the object's circumference. Slack or unwinding forces can in fact be occasionally useful, in particular where spool orbital speed is high and the objects to be wrapped are situated eccentrically with respect to the axis about which the spool orbits. To illustrate, consider a situation where a spool orbiting an object reaches its greatest distance from the object—the longest length of banding material has been unspooled—and owing to the irregular circumference of the object, the length thereafter needs to be rapidly rewound onto the spool to maintain relatively uniform tension as the spool orbits the object. However, if the spool's unspooling speed is high, the inertia/momentum of the spool 20 may prevent the rewinding force exerted by the spool shaft 204 and clutch 210 from acting on the spool 20 in time to maintain substantially constant tension on the banding material. Using a more positively-driven rewinding force, as by using the arrangement of FIG. 2D, or by simply using a servomotor or the like to drive a spool shaft 204 in the desired direction (perhaps without a clutch 210), can address this problem (at least so long as the rewinding force can be controlled to the desired degree at the desired time).

Figure 3A:
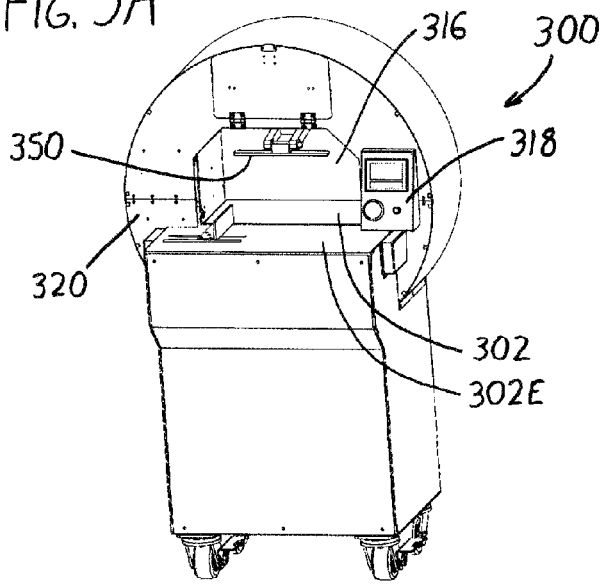
FIG. 3A illustrates a third exemplary banding device 300, wherein an object can be placed atop a support table 302 to situate the object for banding, with the banding being controllable via a control panel 318.
Figure 3B:
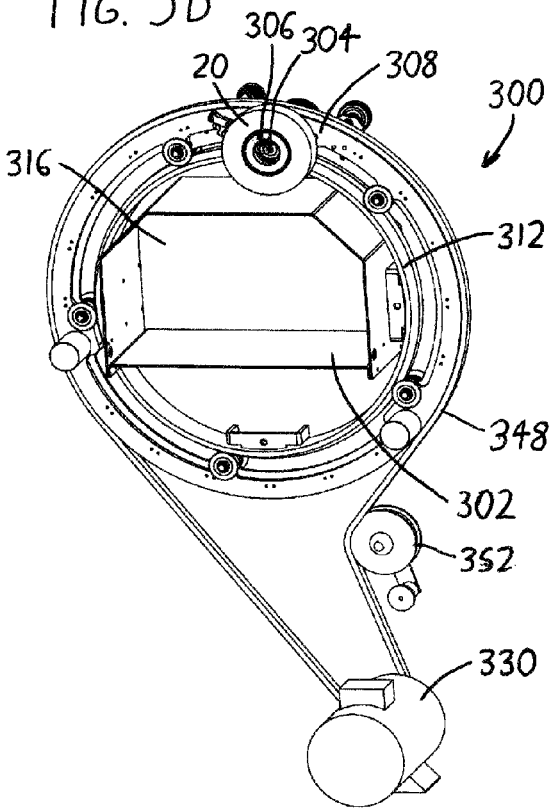
FIG. 3B then illustrates the arrangement of FIG. 3A with the cabinet 320, controls 318, and associated components of FIG. 3A removed, showing the support table 302 affixed within the (stationary) hoop 312, and with the hoop-like spool shaft carriage 308 (and the spool 20 rotatably mounted thereon) riding about the outer circumference of the hoop 312.
Figure 3C:
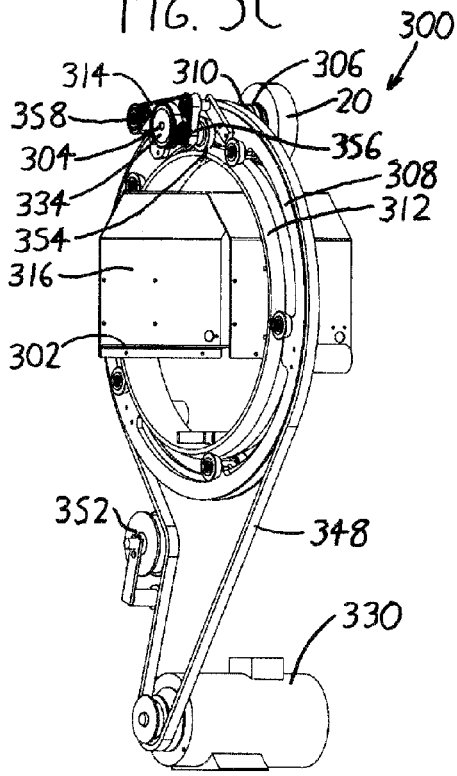
FIG. 3C depicts the arrangement of FIG. 3B from the opposite side.

Turning next to FIGS. 3A-3D, the banding device 300 is shown in FIG. 3A in a finished state, with a cabinet 320 enclosing the hoop 312, carriage 308, spool shaft 304, spool chuck 306, spool 20, and clutch 310 shown in FIGS. 3B-3C. A relocatable registration member 500 is situated on an support table entry section 302E situated forwardly of the remainder of the support table 302, and as will be discussed below in reference to FIG. 3D, the registration member 500 is preferably linked to a gripper carriage 416 which is relocatable along the support table entry section 302E along with the registration member 500. An optional spring-loaded clamping arm 350 is situated within the (open-sided) receiving enclosure 316 and above the support table 302, and can be actuated to clamp down atop an object to be banded at the beginning of a banding cycle (e.g., at FIG. 5A) to hold the object in place. The clamping arm 350 can then be retracted when the cycle is finished (e.g., at FIG. 5L).

FIGS. 3B-3C then illustrate details of the mechanism for actuating the orbit of the spool 20. Looking first to FIG. 3B, the stationary hoop 312 has the receiving enclosure 316 situated therein, and the spool shaft carriage 308 is defined as an outer hoop which rides on the inner stationary hoop 312 via rollers. The carriage 308 is driven about the hoop 312 via a belt 248 operatively connected to a drive motor 330 (with an idler pulley 352 also being shown to maintain belt tension over time). Looking then to FIG. 3C, a pickup roller 354 rotationally mounted on the carriage 308 rides against the hoop 312. A pickup pulley 356 rotates with the pickup roller 354 to engage the interior of a belt 314. The interior of the belt 314 also engages a pair of slave pulleys 358, and the exterior of the belt 314 engages a spool shaft pulley 334. As the carriage 308 rides about the outer circumference of the hoop 312 in a first sense (which is the same sense in which the spool 20 must rotate to unspool banding material), the spool shaft 304 is driven in the opposite second sense, and thereby urges the spool chuck 306 and spool 20 in the second sense owing to the action of the spool shaft 304 and clutch 310 on the spool chuck 306. Thus, the spool shaft 304 urges the spool 20 in the direction opposite the one in which it unwinds.

Figure 3D:
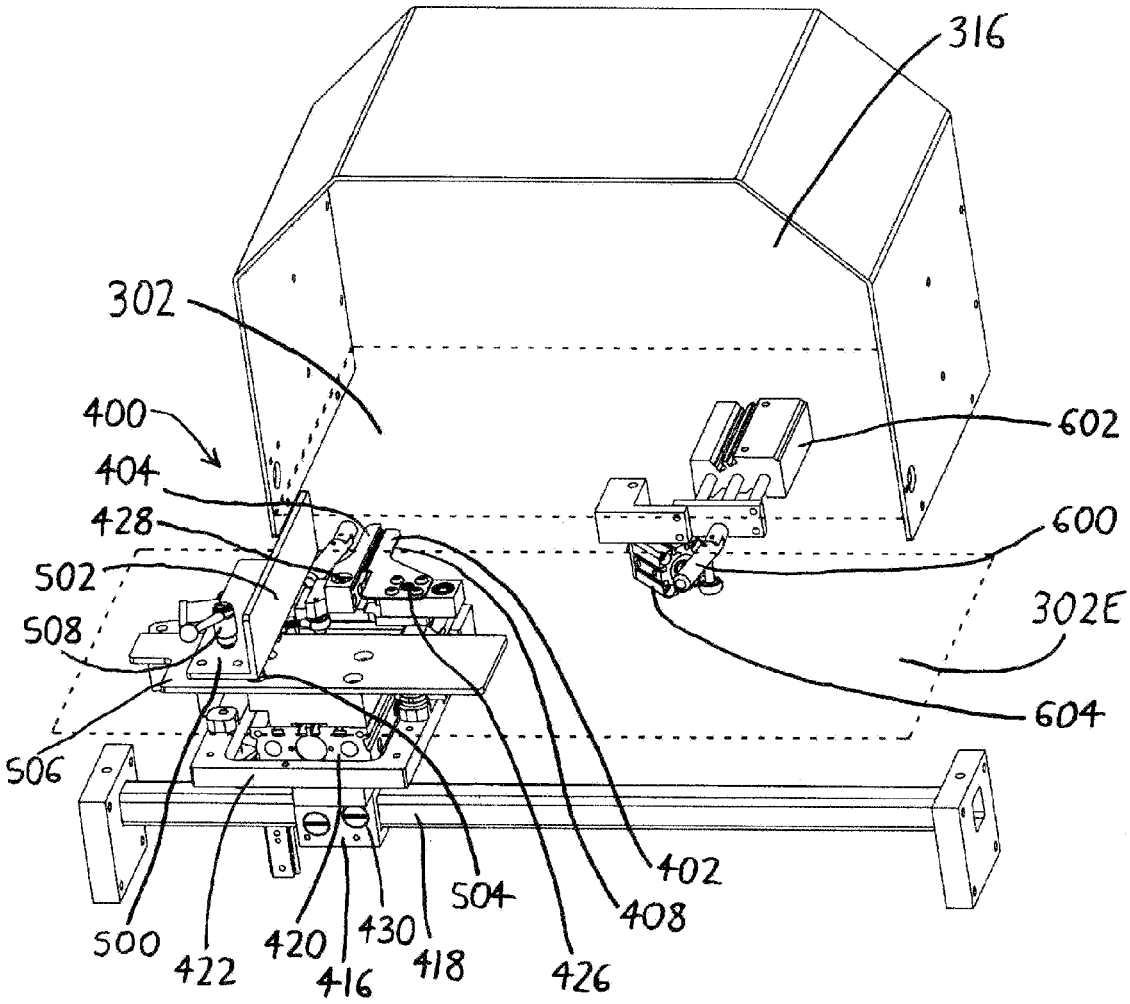
FIG. 3D depicts the support table 302 of FIG. 3A, with its support table entry section 302E being shown in phantom, along with the relocatable gripper carriage 416 and band gripping fingers 402 and 404 beneath the support table entry section 302E, and with the relocatable registration member 500 situated atop the support table entry section 302E.

Turning next to FIG. 3D, the gap between the support table entry section 302E and the remainder of the support table 302 corresponds to the planes in which the spool 20 orbits to unspool banding material onto the object. As can be seen by viewing FIG. 3A in conjunction with FIG. 3D, the registration member 500 may ride along the support table entry section 302E via one or more bolts 504 extending downwardly through slots in the support table entry section 302E to engage a lower plate 506, with the bolt(s) 504 being tightenable via a tightening nut 508 to fix the registration member 500 on the support table entry section 302E. Beneath the registration member 500, the band gripper 400 is similarly relocatable along a rail 418 via a gripper carriage 416 slidably riding on the rail 418, with one or more bolts 430 allowing engagement between the gripper carriage 416 and rail 418 to affix the gripper carriage 416 at a desired location. If desired, the lower plate 506 of the registration member 500 could be affixed to the gripper carriage 416, whereby both the registration member 500 and the gripper carriage 416 can be relocated together to a desired location on the support table entry section 302E. While the registration member 500 is illustrated as a short vertical plate, more complex registration members 500 are possible, e.g., registration members 500 which are shaped to receive objects having particular configurations, and which assist a user with arranging objects into a neatly-aligned stack atop the support table 302 at the location where the objects are to be banded together.

FIG. 3D also illustrates, in simple form, a pair of band support members 600, which may be relocated in a manner similar to the gripper carriage 416 to desired locations along the support table 302 (preferably to locations which correspond to the lower edges of an object to be banded). The actuators for one of the band support members 600 are shown, and include a first linear actuator 604 for pivoting the band support member 600 into planes in which the banding material is applied to the object, and then rotating the member 600 out of these planes once the object has been banded (with the member 600 preferably rotating inwardly, away from the outer circumference of the band). Such pivotal withdrawal of the band support members 600 should avoid disturbing the layers of banding material. A second linear actuator 606 then also translates the band support member 600 (and the first linear actuator 604) toward and away from the planes in which the banding material is applied to the object to further assist in withdrawal of the band support member 600 from the interior of the band. Alternative withdrawal arrangements are possible, such as band support members 600 which apply pressurized gas to release themselves from a band (as with the first band gripping member). While a pair of band support members 600 are depicted in FIG. 3D, it should be understood that more or fewer might be used. For example, finger support members which are positionable in both horizontal and vertical directions might be provided within the receiving enclosure 316 wherein the object to be wrapped is received, with these finger support members being intended to support banding material about upper and lower corners of the object.

It is emphasized that the banding devices 100, 200, and 300, and the banding methodology illustrated in FIGS. 5A-5L, are merely exemplary, and numerous variations on these devices and methods are possible. The invention is not intended to be limited to the exemplary versions, but rather is intended to be limited only by the claims set out below. Thus, the invention encompasses all different versions that fall literally or equivalently within the scope of these claims.

What is claimed is:

1. A banding device including:

a. a support table;

b. a spool:

(1) rotatably situated about a spool axis, the spool axis being restrained to travel in an orbital path about the support table;

(2) being defined by spooled banding material, the banding material having an end restrained adjacent the support table, with the banding material rotationally unwinding from the spool in an unwinding direction as the spool axis orbits the support table;

(3) wherein the spool is always rotationally urged in a winding direction opposite the unwinding direction with a substantially constant urging force as the spool axis orbits the support table.

2. The banding device of claim 1 further including a clutch situated about the spool axis, wherein the clutch always restrains the spool to resist rotation in the first sense as the spool axis orbits the support table in the first sense.

3. The banding device of claim 1 further including a rotating arm having an arm rotational axis situated above the support table, wherein:

a. the spool axis is defined by a spool shaft connected to the rotating arm at a location spaced from the arm rotational axis, and b. the spool shaft is linked with respect to the rotating arm to be driven to rotate in the second sense as the spool shaft orbits the support table.

4. The banding device of claim 1 further including a hoop wherein:

a. the support table is situated within the hoop, and b. the spool axis is defined by a spool shaft riding on the hoop to orbit the support table.

5. The banding device of claim 4 further including a carriage mounted to ride on the hoop, wherein the spool shaft is rotatably affixed with respect to the carriage.

6. The banding device of claim 4 wherein:

a. the hoop is mounted to rotate about the support table, and b. the spool shaft is rotatably affixed with respect to the hoop.

7. The banding device of claim 6 further including a second hoop situated about the central axis of the first hoop, wherein the spool shaft is engaged with respect to the second hoop to be driven in the second sense as the hoop rotates about the support table.

8. The banding device of claim 7 wherein the second hoop is fixed such that it cannot rotate with respect to the support table.

9. The banding device of claim 1 further including a band support member movable into, and out of, a band support location located:

a. adjacent to the support table, and b. in planes in which the banding material unwinds from the spool.

10. The banding device of claim 9 wherein the band support member pivotally moves into, and out of, the band support location along a plane oriented at least substantially parallel to the support table.

11. The banding device of claim 9 further including a band support carriage:

a. translatably affixed with respect to the support table such that the band support carriage may translate along planes parallel to the support table, b. whereupon the band support member is pivotally mounted to move into, and out of, the band support location.

12. The banding device of claim 1 further including a registration member:

a. translatably affixed with respect to the support table such that the registration member may translate across the support table along planes parallel to the support table, b. having a side edge oriented at least substantially parallel to the spool axis.

13. The banding device of claim 1 further including first and second band gripping fingers wherein:

a. the first and second band gripping fingers are movable into, and out of, a band gripping location located:

(1) adjacent to the support table, and (2) in planes in which the banding material unwinds from the spool, b. at least one of the first and second band gripping fingers is movable into engagement with the other, whereby the first and second band gripping fingers may grasp banding material therebetween;

c. at least one of the first and second band gripping fingers has a fluid passage opening thereon, the fluid passage being in connection with a source of pressurized gas.

14. The banding device of claim 1 further including first and second band gripping fingers wherein:

a. the first and second band gripping fingers are movable into, and out of, a band gripping location located:

(1) adjacent to the support table, and (2) in planes in which the banding material unwinds from the spool, b. the first and second band gripping fingers include:

(1) proximal finger sides situated adjacent the support table, and (2) distal finger sides situated opposite the proximal finger sides, and distant from the support table, wherein the distal finger side of the first band gripping finger is located more distantly from the support table than the distal finger side of the second band gripping finger;

(3) gripping faces situated between the proximal and distal finger sides, wherein the gripping face of the second band gripping finger is movable into, and out of, engagement with the gripping face of the first band gripping finger, c. the first band gripping finger is located closer to a plane:

(1) aligned with the axis about which the spool axis orbits the support table, and (2) oriented perpendicularly with respect to the support table, than the second gripping finger.

15. The banding device of claim 14 wherein the first and second band gripping fingers are situated on a finger carriage translatably affixed with respect to the support table, such that the finger carriage and the first and second band gripping fingers may translate across the support table along planes parallel to the support table.

16. The banding device of claim 15 further including a registration member:

a. connected to the finger carriage to be translatably affixed with respect to the support table, and b. having a side edge oriented at least substantially parallel to the spool axis.

17. The banding device of claim 14 wherein the first band gripping finger has a fluid passage therein:

a. in connection with a source of pressurized gas, and b. opening at or adjacent to the distal finger side of the first band gripping finger.

18. A method of using the banding device of claim 14 including the following steps in sequence:

a. grasping banding material unspooled from the spool between the gripping faces of the first and second band gripping fingers at the band gripping location;

b. orbiting the spool about the support table, with banding material rotationally unwinding from the spool in the first sense while wrapping about:

(1) an object on the support table, and (2) the gripping fingers at the band gripping location;

c. after the banding material has wrapped about the object and the gripping fingers at least once, (1) moving the gripping face of the second band gripping finger out of engagement with the gripping face of the first band gripping finger, thereby releasing the banding material unspooled from the spool;

(2) moving the first and second band gripping fingers out of the band gripping location;

d. moving the first band gripping finger into the band gripping location, with the first band gripping finger being situated between the banding material and the object;

e. moving the gripping face of the second band gripping finger into engagement with the gripping face of the first band gripping finger, with the banding material being situated between the gripping faces of the band gripping fingers; and f. cutting the banding material at a location between or adjacent to the band gripping fingers.

19. The method of claim 18 wherein the gripping fingers, when in the band gripping location, are located:

i. adjacent to the object on the support table, and ii. between opposing sides of the object on the support table, such that when the banding material has wrapped about the object and the gripping fingers at least once, the second band gripping finger rests within a space defined between the first band gripping finger, the object, and the banding material, with the banding material extending along a planar path between the first band gripping finger and the object.

20. The method of claim 18 further including the step of emitting pressurized gas from the first band gripping finger toward the banding material before moving the first and second band gripping fingers out of the band gripping location.

21. A method of using the banding device of claim 1 wherein the banding device further includes first and second band gripping fingers:

A. movable into, and out of, a band gripping location located:

i. adjacent to the support table, and ii, in planes in which the banding material unwinds from the spool, and B. wherein at least one of the first and second band gripping fingers is movable into engagement with the other;

the method including the following steps in sequence:

a. grasping banding material unspooled from the spool between the first and second band gripping fingers at the band gripping location;

b. orbiting the spool about the support table, with banding material rotationally unwinding from the spool in the first sense while wrapping about:

(1) an object on the support table, and (2) the first gripping finger at the band gripping location, with the second band gripping finger resting between the first band gripping finger, the object, and the banding material without exerting pressure on the banding material;

c. after the banding material has wrapped about the object and the first gripping finger at least once,
(1) releasing the end of the banding material from between the first and second band gripping fingers;
(2) moving the first and second band gripping fingers out of the band gripping location;
d. moving the first band gripping finger into the band gripping location, with the first band gripping finger being situated between the banding material and the object;
e. grasping the banding material between the first and second band gripping fingers at the band gripping location; and
f. cutting the banding material at a location between or adjacent to the band gripping fingers.

22. The method of claim 21 further including the step of emitting pressurized gas from the first band gripping finger toward the banding material before moving the first and second band gripping fingers out of the band gripping location.

23. A banding device including:
a. a support table;
b. a spool shaft orbiting the support table along an orbital path,
c. a spool chuck rotatably mounted on the spool shaft, whereby banding material wound about the spool chuck may be unwound in an unwinding direction about an object on the support table as the spool chuck orbits the support table;
wherein the spool shaft is always rotated in a winding direction opposite the unwinding direction when banding material wound about the spool chuck is unwound about an object on the support table.

24. The banding device of claim 23 further including first and second band gripping fingers wherein:
a. the first and second band gripping fingers are movable into, and out of, a band gripping location located:
(1) adjacent to the support table, and
(2) in planes in which the spool chuck orbits the support table,
b. at least one of the first and second band gripping fingers is movable into engagement with the other to grasp banding material therebetween;
c. at least one of the first and second band gripping fingers has a fluid passage opening thereon, the fluid passage being in connection with a source of pressurized gas.

25. A banding device including:
a. a support table;
b. a spool shaft rotatably affixed with respect to the support table to orbit the support table;
c. a clutch which orbits with the spool shaft;
d. a spool:
(1) rotatably mounted with respect to the spool shaft;
(2) having banding material spooled thereon, the banding material having an end restrained adjacent the support table, with the banding material rotationally unwinding from the spool in an unwinding direction as the spool shaft orbits the support table;
(3) wherein the spool is rotationally urged by the clutch in a winding direction opposite the unwinding direction as the spool shaft orbits the support table.

* * * * *